US006118355A

United States Patent [19]

Pelz et al.

[11] Patent Number: 6,118,355

[45] Date of Patent: Sep. 12, 2000

[54] DUAL BAND COMBINER ARRANGEMENT

[75] Inventors: Dieter Pelz; Noel McDonald, both of Croydon, Australia

[73] Assignee: Alcatel, Paris, France

[21] Appl. No.: 09/327,508

[22] Filed: Jun. 8, 1999

[30] Foreign Application Priority Data

Aug. 7, 1998 [AU] Australia ..... PP5120

[51] Int. Cl.[7] ..... H01P 1/213

[52] U.S. Cl. ..... 333/134; 333/204

[58] Field of Search ..... 333/126, 134, 333/135

[56] References Cited

U.S. PATENT DOCUMENTS 2,965,752 12/1960 Medford et al. ..... 333/126 X
5,023,866 6/1991 De Muro ..... 333/134 X
5,281,934 1/1994 Shiau et al. ..... 333/134
5,652,599 7/1997 Pitta et al. ..... 333/126 X

*Primary Examiner*—Paul Gensler
*Attorney, Agent, or Firm*—Sughrue, Mion, Zinn, Macpeak & Seas, PLLC

[57] ABSTRACT

A dual band combiner for combining two frequency bands having a 2:1 relationship, e.g. 900 MHz and 1800 MHz. The combiner comprises an upper frequency bandpass filter section and an upper frequency bandstop filter. The bandpass filter section comprises two open-end resonators whose lengths are ½ wavelength of the upper frequency band, and the bandstop filter comprises three open-end resonators whose lengths are ¼ wavelength of the upper frequency band. Because of the 2:1 frequency relationship pronounced selectivity-enhancing transmission zeros are produced at the lower frequency band, thereby providing a combiner that has high isolation between ports while maintaining low insertion loss.

9 Claims, 2 Drawing Sheets

DUAL BAND COMBINER ARRANGEMENT

BACKGROUND OF THE INVENTION

This invention relates to radio frequency dual band combiners, for combining signals into two different frequency bands, for example, 900 MHz and 1800 MHz, for connection to a single feeder cable via a common port of the combiner.

A combiner of the aforementioned type must have, on the one hand, high isolation between the two frequency bands, and on the other hand, a low insertion loss.

Such requirements are difficult to implement because high isolation demands elaborate filters, and elaborate filters lead to increased insertion loss.

High isolation combiners using coaxial bandpass filters are known, but their insertion loss is usually unattractively high which reduces overall system performance. Bandpass-band reject combiners are known. However, the insertion loss in the bandpass branch is relatively high in most cases.

If a combiner is to be realized in planar structure, i.e. using microstrip filters, then maximum resonator Q is very low compared to coaxial resonator bandpass filters, which also leads to increased insertion loss.

SUMMARY OF THE INVENTION

It is an object of the present invention to provide a planar structure dual band combiner arrangement, having low insertion loss and high isolation between bands.

According to the invention there is provided a dual band combiner arrangement comprising an upper frequency band filter means coupled to a first port, a lower frequency band filter means coupled to a second port, and a common port coupled to both said filter means, the upper frequency band's center frequency and the lower frequency band's center frequency having approximately a 2:1 frequency relationship, said upper frequency band filter means comprising a plurality of first open-end resonators whose respective lengths are one half the wavelength of said upper frequency band's center frequency, and said lower frequency band filter means comprising a plurality of second open-end resonators whose respective lengths are one quarter of the wavelength of said upper frequency band's center frequency, whereby said first filter means forms a bandpass filter for passing the upper frequency band and rejecting the lower frequency band, and said second filter means forms a bandstop filter that passes said lower frequency band and rejects the upper frequency band.

BRIEF DESCRIPTION OF THE DRAWING

In order that the invention may be carried into effect, an embodiment thereof will now be described in relation to the accompanying drawings, in which.

DETAILED DESCRIPTION OF THE INVENTION

Figure 1:
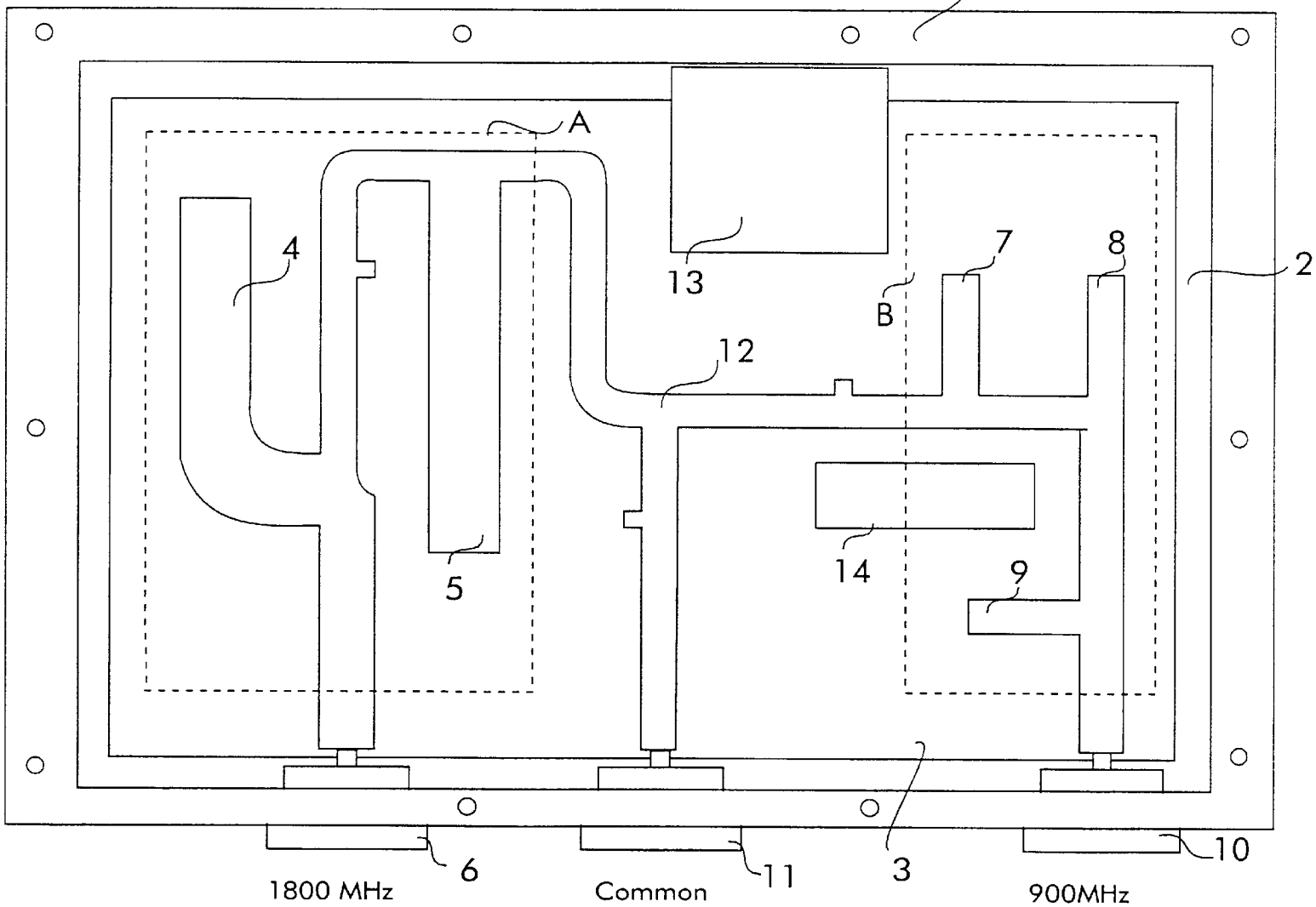
FIG. 1 shows a top view of a combiner incorporating the present invention.

Referring to FIG. 1, the combiner comprises a rectangular metal housing 1 having a bottom panel 2 and a removable top panel (not shown). Mounted within the housing is a printed circuit board 3 upon which is supported a conductive pattern forming an 1800 MHz bandpass filter section generally defined by the broken line A, and 1800 MHz bandstop filter section generally defined by the broken line B.

The 1800 MHz bandpass filter comprises two open-end stub halfwave resonators 4 and 5 coupled to an 1800 MHz port 6.

The 1800 MHz bandstop filter section comprises three open-end stub quarter wavelength resonators 7, 8 and 9 coupled to a 900 MHz port 10.

Both filter sections are coupled to a common port 11 via conductive path 12.

Preferably, the combiner includes two solid metal blocks 13 and 14. The blocks are dimensioned such that they form an electrical connection between the top panel of the housing means and the bottom panel of the housing means. The function of block 13 is to suppress cavity-type resonances of the housing; the function of block 14 is to suppress unwanted electromagnetic coupling between the 900 MHz and 1800 MHz paths which would reduce the isolation between ports 6 and 10.

Figure 2:
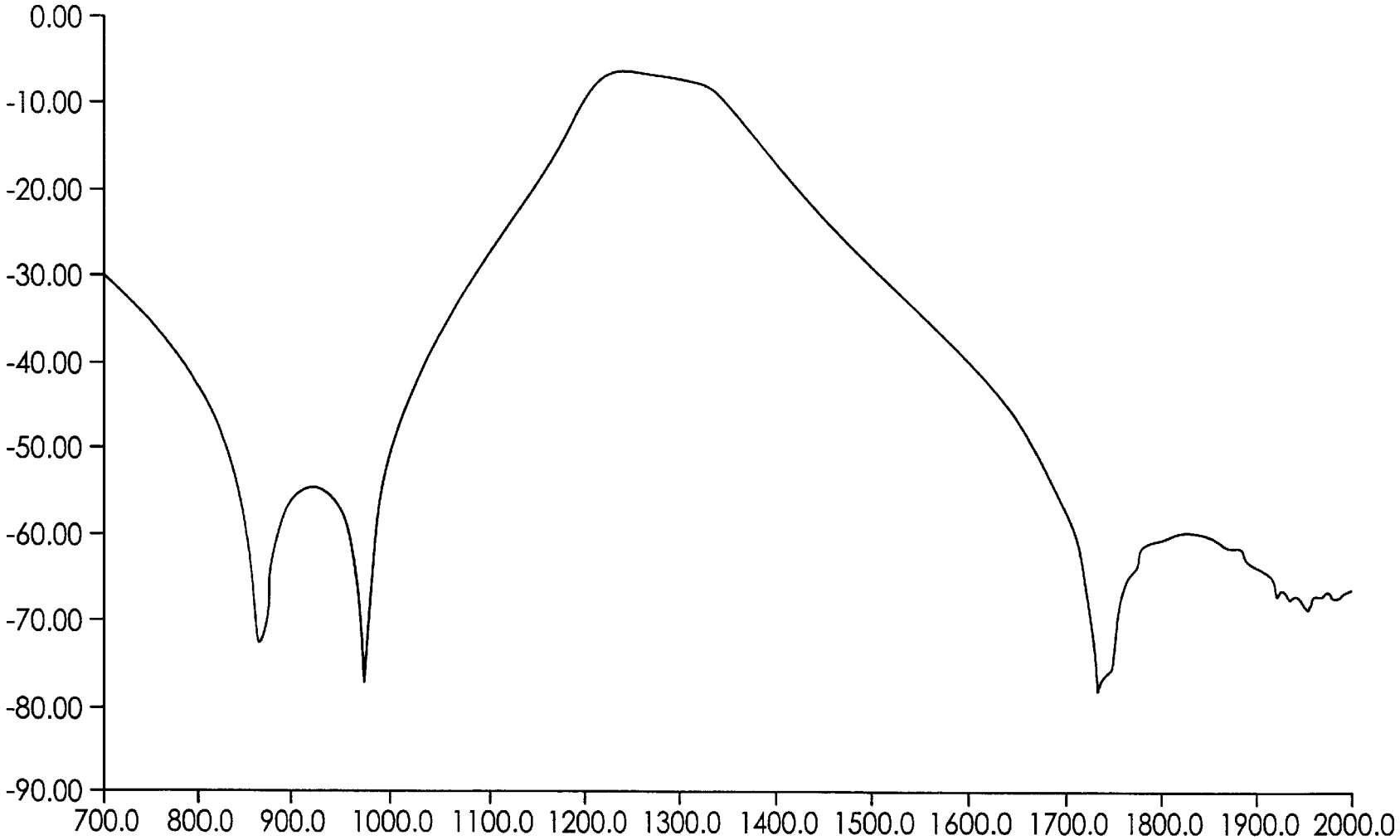
FIG. 2 graphically represents isolation responses between the 900 MHz and 1800 MHz ports of the combiner shown in FIG. 1.

In order to provide the required high isolation between ports, typically >56 dB while maintaining a low insertion loss, typically <0.3 dB, the 1800 MHz bandpass filter of the combiner arrangement described above produces transmission zeros in the lower frequency which increases the bandpass filter's selectivity. The arrangement exploits the fact, that the two frequency bands to be combined are in an approximately 2:1 frequency relationship. The two open-end halfwave resonators 4 and 5 of the 1800 MHz bandpass filter become quarterwave resonators at 900 MHz and thus produce pronounced selectivity—enhancing transmission zeros at 900 MHz (see FIG. 2). In this way an otherwise moderately selective 2—resonator filter becomes very selective in its lower stopband at 900 MHz frequencies. As can be seen FIG. 1 the resonators 4 and 5 of 1800 MHz bandpass filter are connected to the main signal path. While the open-end stub resonators are halfwave at 1800 MHz and hence do not affect the passing of 1800 MHz signals, they become quarterwave long at 900 MHz and their open-end transforms into a short-circuit to ground at 900 MHz, not allowing 900 MHz signals to pass, i.e. producing transmission zeros at 900 MHz.

The 1800 MHz bandstop filter in the 900 MHz path rejects 1800 MHz signals due to the short-circuit producing quarterwave resonators 7, 8 and 9. At 900 MHz these resonators are an eighth of a wavelength long which makes them act like a capacitive loading of the 900 MHz transmission path. This loading is compensated by the network interaction of the 3-resonator filter and hence, 900 MHz signals pass through without attenuation.

It will be understood that the combiner can be adapted to other combinations of frequency bands provided that they have approximately a 2:1 frequency relationship.

The combiner can be utilized in an antenna arrangement. Also, it can be used as a splitter, where two signals from suitable sources are simultaneously fed to the common port and then split into two separate signals available at two output ports.

The claims defining the invention are as follows:

1. A dual band combiner arrangement comprising an upper frequency band filter means coupled to a first port, a lower frequency band filter means coupled to a second port, and a common port coupled to both said filter means, the upper frequency band's center frequency and the lower frequency band's center frequency having approximately a 2:1 frequency relationship, said upper frequency band filter means comprising a plurality of first open-end resonators whose respective lengths are one half the wavelength at said upper frequency band's center frequency, and said lower frequency band filter means comprising a plurality of second open-end resonators whose respective lengths are one quarter of the wavelength at said upper frequency band's center frequency, whereby said first filter means forms a bandpass filter for passing the upper frequency band and rejecting the lower frequency band, and said second filter means forms a bandstop filter that passes said lower frequency band and rejects the upper frequency band.

2. A dual band combiner arrangement as claimed in claim 1, wherein said upper frequency band filter means comprises two open-end resonators whose respective lengths are one half the wavelength at said upper frequency band's center frequency, and said lower frequency band filter means comprises three open-end resonators whose respective lengths are one quarter of the wavelength at said upper frequency band's center frequency.

3. A dual band combiner arrangement as claimed in 1, wherein said upper frequency band filter means and said lower frequency band filter means are in the form of a predetermined pattern of conductive material supported on a planar board of insulating material.

4. A dual band combiner arrangement as claimed in claim 1, including means to suppress cavity-type resonances.

5. A dual band combiner arrangement as claimed in claim 4, wherein said means to suppress cavity-type resonances comprises a solid metal block fixed in a predetermined location between the said upper frequency band filter means on the lower frequency band filter means.

6. A dual band combiner arrangement as claimed in claim 1, including means to suppress unwanted electromagnetic coupling between parts of the said upper frequency band filter means and parts of said lower frequency band filter means.

7. A dual band combiner arrangement as claimed in claim 1, wherein the upper frequency bands center frequency is 1800 MHz, and the lower frequency bands center frequency is 900 MHz.

8. A dual band combiner arrangement as claimed in claim 1, mounted within a metal housing means.

9. A dual band combiner arrangement as claimed in claim 1, operatively associated with an antenna arrangement.

* * * * *